US011939690B2

(12) United States Patent
Tabor et al.

(10) Patent No.: US 11,939,690 B2
(45) Date of Patent: Mar. 26, 2024

(54) PORTABLE AND MODULAR PRODUCTION ELECTROPLATING SYSTEM

(71) Applicant: Snap-on Incorporated, Kenosha, WI (US)

(72) Inventors: Kraig A. Tabor, East Troy, WI (US); Thomas L. Kassouf, Port Washington, WI (US); Ricardo M. Guedes, Kenosha, WI (US); Greg P. Formella, Germantown, WI (US); Alan J. Birschbach, Pleasant Prairie, WI (US); Peter W. Eisch, West Allis, WI (US); Garry L. Dillon, Kenosha, WI (US); Chad J. Kaschak, Oak Creek, WI (US); Michael G. Gentile, Grayslake, IL (US)

(73) Assignee: Snap-on Incorporated, Kenosha, WI (US)

( * ) Notice: Subject to any disclaimer, the term of this patent is extended or adjusted under 35 U.S.C. 154(b) by 412 days.

(21) Appl. No.: 16/239,759

(22) Filed: Jan. 4, 2019

(65) Prior Publication Data

US 2019/0136402 A1 May 9, 2019

Related U.S. Application Data

(62) Division of application No. 15/472,606, filed on Mar. 29, 2017, now Pat. No. 10,294,579.

(Continued)

(51) Int. Cl.

*C25D 21/08* (2006.01)
*C25D 5/08* (2006.01)

(Continued)

(52) U.S. Cl.

CPC ..... *C25D 21/08* (2013.01); *C25D 5/08* (2013.01); *C25D 17/00* (2013.01); *C25D 17/02* (2013.01);

(Continued)

(58) Field of Classification Search

CPC ..... C25D 21/08; C25D 21/20

See application file for complete search history.

(56) References Cited

U.S. PATENT DOCUMENTS 2,206,908 A 7/1940 Lunt
3,752,752 A 8/1973 Slatin (Continued)

FOREIGN PATENT DOCUMENTS

CN 101717987 6/2010
CN 105063733 11/2015

(Continued)

OTHER PUBLICATIONS

Jia et al., Machine Translation CN 105297119 A (Year: 2016).*

(Continued)

*Primary Examiner* — Hosung Chung
(74) *Attorney, Agent, or Firm* — Seyfarth Shaw LLP

(57) ABSTRACT

A portable electroplating system with components integrated into a complete system, rather than separated and disjointed. A single electroplating system can be self-contained to include all necessary rectifiers, tanks, cleaning functionalities, and other helpful or necessary items. By using smaller components than conventional electroplating systems, the system can allow for more economical use of chemicals, solutions, and energy and can be utilized more efficiently towards a unique shape or size of object to be plated. The system can also include wheels to make the (Continued)

system portable. A rack management system can be employed to move objects from one location to another within the system.

7 Claims, 5 Drawing Sheets

Related U.S. Application Data

(60) Provisional application No. 62/331,709, filed on May 4, 2016, provisional application No. 62/318,391, filed on Apr. 5, 2016.

(51) Int. Cl.

| | |
|---|---|
| ***C25D 17/00*** | (2006.01) |
| ***C25D 17/02*** | (2006.01) |
| ***C25D 17/04*** | (2006.01) |
| ***C25D 17/06*** | (2006.01) |
| ***C25D 17/08*** | (2006.01) |
| ***C25D 17/10*** | (2006.01) |
| ***C25D 21/10*** | (2006.01) |
| ***C25D 21/12*** | (2006.01) |

(52) U.S. Cl.

CPC ..... *C25D 17/04* (2013.01); *C25D 17/06* (2013.01); *C25D 17/08* (2013.01); *C25D 17/10* (2013.01); *C25D 21/10* (2013.01); *C25D 21/12* (2013.01)

(56) References Cited

U.S. PATENT DOCUMENTS

| | | | | |
|---|---|---|---|---|
| 3,869,372 | A | 3/1975 | Becker | |
| 3,907,649 | A | 9/1975 | Becker | |
| 4,081,347 | A | 3/1978 | Becker | |
| RE29,874 | E | 1/1979 | Becker | |
| 4,157,942 | A | 6/1979 | Tuznik et al. | |
| 4,592,819 | A | 6/1986 | Suzuki et al. | |
| 4,654,089 | A * | 3/1987 | Singelyn | C23G 1/24 134/10 |
| 4,668,364 | A | 5/1987 | Farmer et al. | |
| 5,149,411 | A | 9/1992 | Castle | |
| 5,228,967 | A | 7/1993 | Crites et al. | |
| 5,346,602 | A | 9/1994 | McLaughlin | |
| 5,384,026 | A | 1/1995 | McLaughlin | |
| 5,391,279 | A | 2/1995 | McLaughlin | |
| 5,415,890 | A | 5/1995 | Kloiber et al. | |
| 5,482,605 | A | 1/1996 | Taylor | |
| 5,496,457 | A | 3/1996 | Antelman et al. | |
| 5,514,258 | A | 5/1996 | Brinket et al. | |
| 5,788,829 | A * | 8/1998 | Joshi | C25D 17/06 204/230.2 |
| 6,551,488 | B1 | 4/2003 | Hey et al. | |
| 6,858,119 | B2 | 2/2005 | Kidd et al. | |
| 8,734,624 | B2 | 5/2014 | Minami | |
| 2002/0179121 | A1 * | 12/2002 | Moehle | C25D 21/18 134/26 |
| 2008/0156757 | A1 * | 7/2008 | Lin | C25D 17/08 211/116 |
| 2011/0073469 | A1 | 3/2011 | Ma et al. | |
| 2012/0100287 | A1 * | 4/2012 | Wong | B05C 3/10 427/127 |
| 2012/0175248 | A1 * | 7/2012 | Vasquez | C25D 7/0621 204/275.1 |
| 2012/0279863 | A1 | 11/2012 | Buschur | |
| 2017/0037529 | A1 * | 2/2017 | Logan | C25D 17/08 |

FOREIGN PATENT DOCUMENTS

| | | | | |
|---|---|---|---|---|
| CN | 105297119 A | * | 2/2016 | |
| CN | 105316752 A | * | 2/2016 | |
| CN | 105442030 | | 3/2016 | |
| EP | 3239365 B1 | | 2/2020 | |
| GB | 2334037 | | 8/1999 | |
| GB | 2334037 A | * | 8/1999 | C25D 17/08 |
| JP | S5139621 | | 3/1976 | |

OTHER PUBLICATIONS

Merriam-Webster, Proximal, Merriam-Webster OnLine (Year: 2010).*
Zhang, Machine Translation, CN 105316752 A (Year: 2016).*
European Search Report for Application No. EP17164527.8, dated Dec. 15, 2017 (15 pages).
Chinese Office Action for Application No. 101710218577.3 dated Jul. 23, 2018, 13 pages.
European Office Action for Application No. 17164527.8 dated Sep. 13, 2018, 7 pages.
Canadian Office Action for Application No. 2,963,101 dated Jun. 6, 2018, 5 pages.
Taiwan Office Action for Application No. 106111328 dated Mar. 6, 2018, 5 pages.
Australian Examination Report No. 1 for Application No. 2017202213 dated Feb. 27, 2018, 4 pages.
Canadian Examiner's Report for Application No. 2,963,101 dated Feb. 7, 2019, 3 pages.
Chinese Decision of Rejection for Application No. 201710218577.3 dated Apr. 9, 2019, 7 pages.
European Examination Report for Application No. 17164527.8 dated May 8, 2019, 4 pages.
European Search Report for Application No. 19197040.9, dated Oct. 18, 2019, 38 pages.
Australian Examination Report No. 1 for Application No. 2019204152, dated Nov. 13, 2019, 2 pages.
Office Action for corresponding Application No. 2021107262753 dated Aug. 22, 2023, 12 pages.

* cited by examiner

PORTABLE AND MODULAR PRODUCTION ELECTROPLATING SYSTEM

CROSS-REFERENCES TO RELATED APPLICATIONS

This application is a divisional application of and claims the benefit of U.S. patent application Ser. No. 15/472,606, filed Mar. 29, 2017, titled Portable and Modular Production Electroplating System, which claims the benefit of U.S. Provisional Patent Application Ser. No. 62/318,391, filed Apr. 5, 2016, titled Portable and Modular Production Electroplating System, and U.S. Provisional Patent Application Ser. No. 62/331,709, filed May 4, 2016, titled Portable and Modular Production Electroplating System, the contents of which are incorporated herein by reference in their entirety.

TECHNICAL FIELD OF THE INVENTION

The present invention relates generally to electroplating systems. More particularly, the present invention relates to portable electroplating systems capable of efficiently plating smaller quantities of objects.

BACKGROUND OF THE INVENTION

Electroplating systems use electrochemistry to form a thin layer of a material, typically metallic, with ionic forces. Other metals can be electroplated to form a functional layer of protection against, e.g., corrosion (e.g., zinc), or provide an aesthetic coating that improves the look of the plated object (e.g., chrome).

Most electroplating systems are large, and electroplate large quantities of objects at once. These systems are typically referred to as "monuments," and can sit within a pit or other permanent area such that such electroplating systems are not portable or mobile. The size of the electroplating systems also requires large quantities of chemical solutions, and in turn, energy to heat the chemical solutions to a required electroplating temperature. The size also prevents the systems from being optimized for a particular size or shape of object because the entire system would need to be reconfigured and would be burdensome for such a large system. Commonly, a factory will include one or only a few electroplating systems due to the necessary size and costs of the systems.

Commercially available small-scale electroplating systems include separate, non-integrated sections pieced together, rather than an integral, complete system. However, these sections commonly lack functionality such as ultrasonic capabilities, filtering systems, resin treatment sections, chemistry monitoring, and other functionality. Existing systems also lack functionality to efficiently move objects from one tank to the other.

SUMMARY OF THE INVENTION

The present invention broadly comprises an electroplating system with components integrated into a complete system. For example, a single system can include all necessary rectifiers, tanks, ultrasonic capabilities, and other required functionality. The system can be smaller than conventional electroplating systems to allow for economical use of chemicals and energy, and can include wheels or other means for movement to allow the system to be portable. A rack management system can further be included to efficiently move products from one tank to another. For example, in an embodiment, the present invention includes 12 tanks.

In an embodiment, the present invention is an electroplating system for plating objects and broadly comprises a frame, a plating tank disposed on the frame, and first and second rinse tanks disposed on the frame in sequence with the plating tank for process flow. The second rinse tank may be adapted to receive water from a water supply, and the water may be adapted to flow from the second rinse tank to the first rinse tank. An acid cleaning tank may also disposed on the frame in sequence prior to the second rinse tank for process flow. The system may also include a rack for transporting objects to and from the plating tank, the first and second rinse tanks, and the acid cleaning tank.

A method is also disclosed for cleaning objects for plating. The method may broadly comprise causing de-ionized water to flow from a supply source to a first rinse tank, and allowing the de-ionized water to flow from the first rinse tank to a second rinse tank. An object to be plated can be placed in the second rinse tank, and rinsed in the second rinse tank. Thereafter, the object can be placed in an acid cleaning tank. The object may then be placed in the first rinse tank after placing the object in the acid cleaning tank. This method facilitates the use of acid drag-out to act as a purifying agent in the rinse tank(s).

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
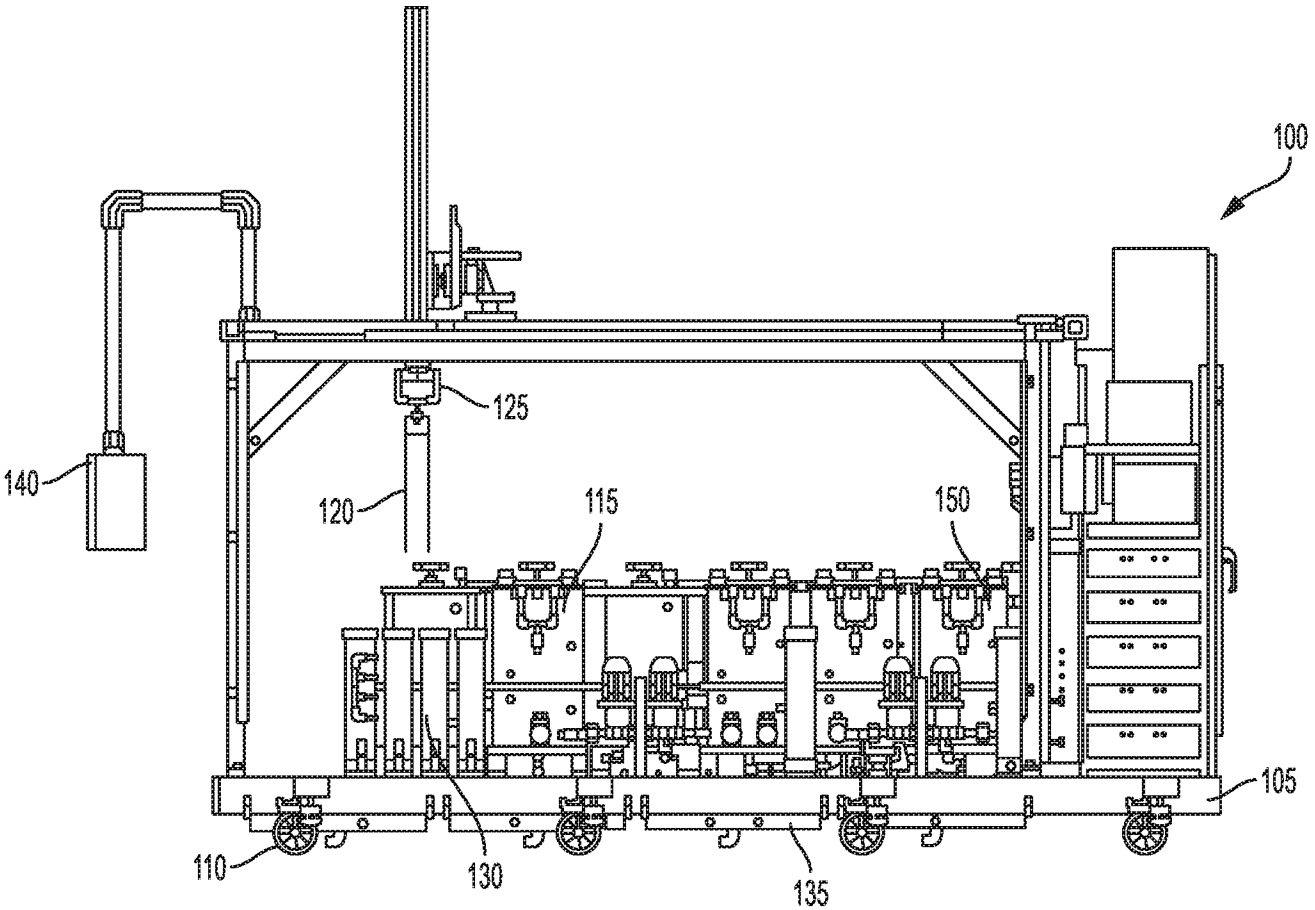
FIG. 1 is a side elevational view of an electroplating system according to embodiments of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises an integrated electroplating system that includes typical components for electroplating within a single complete system. For example, a single electroplating system can include rectifiers, tanks, ultrasonic capabilities, cleaning functionalities, and other components rather than having these components separate and disjointed from the system. The system of the present invention can be smaller than conventional electroplating systems for economical use of chemicals and energy and customizable operations for uniquely shaped objects. The system can also be portable or mobile and a moving device, such as, for example, wheels or a palate. A rack management system can further be included to move objects that are to be plated from one component to another within the system.

Figure 2:
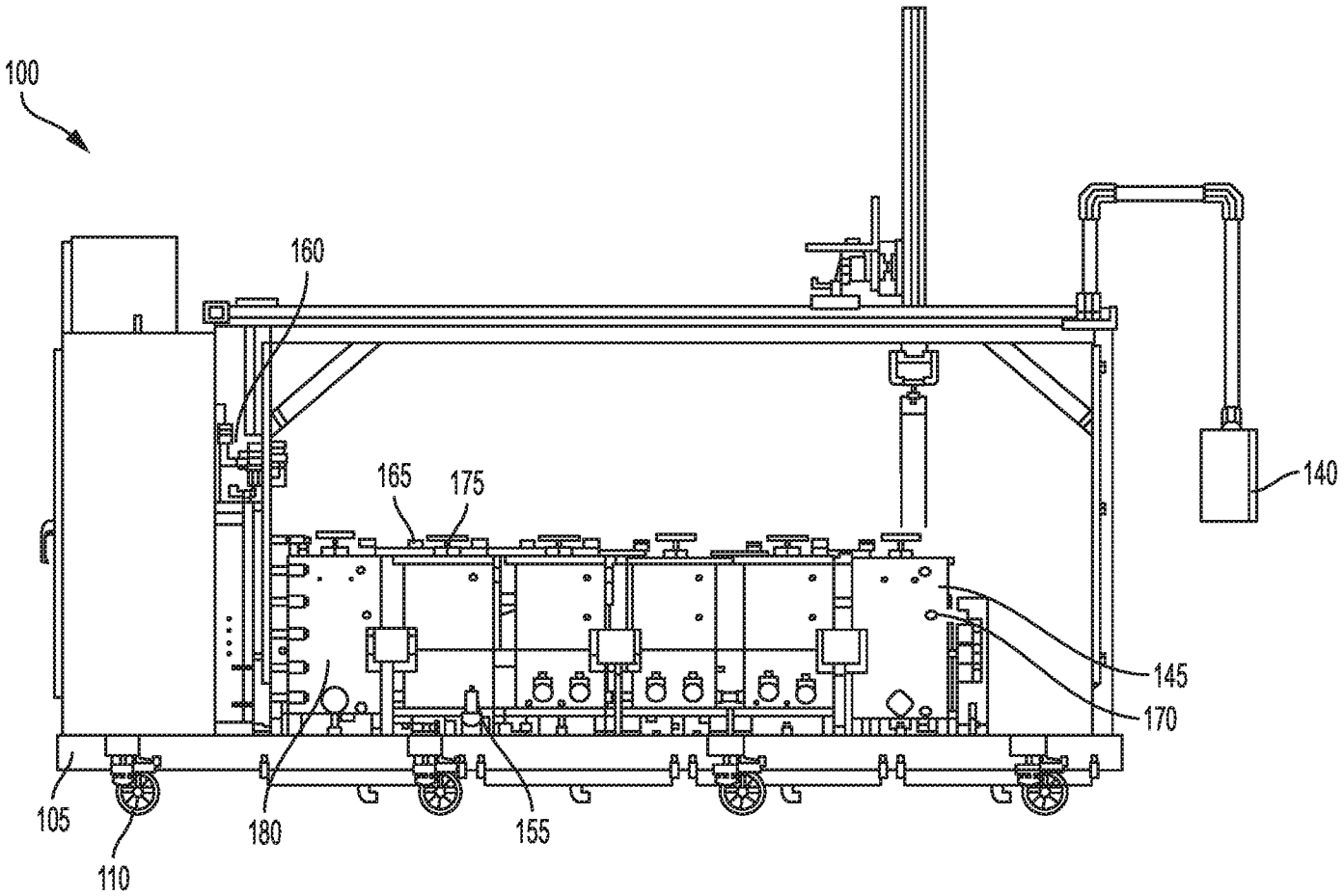
FIG. 2 is an opposing side elevation view of the electroplating system of FIG. 1.
Figure 3:
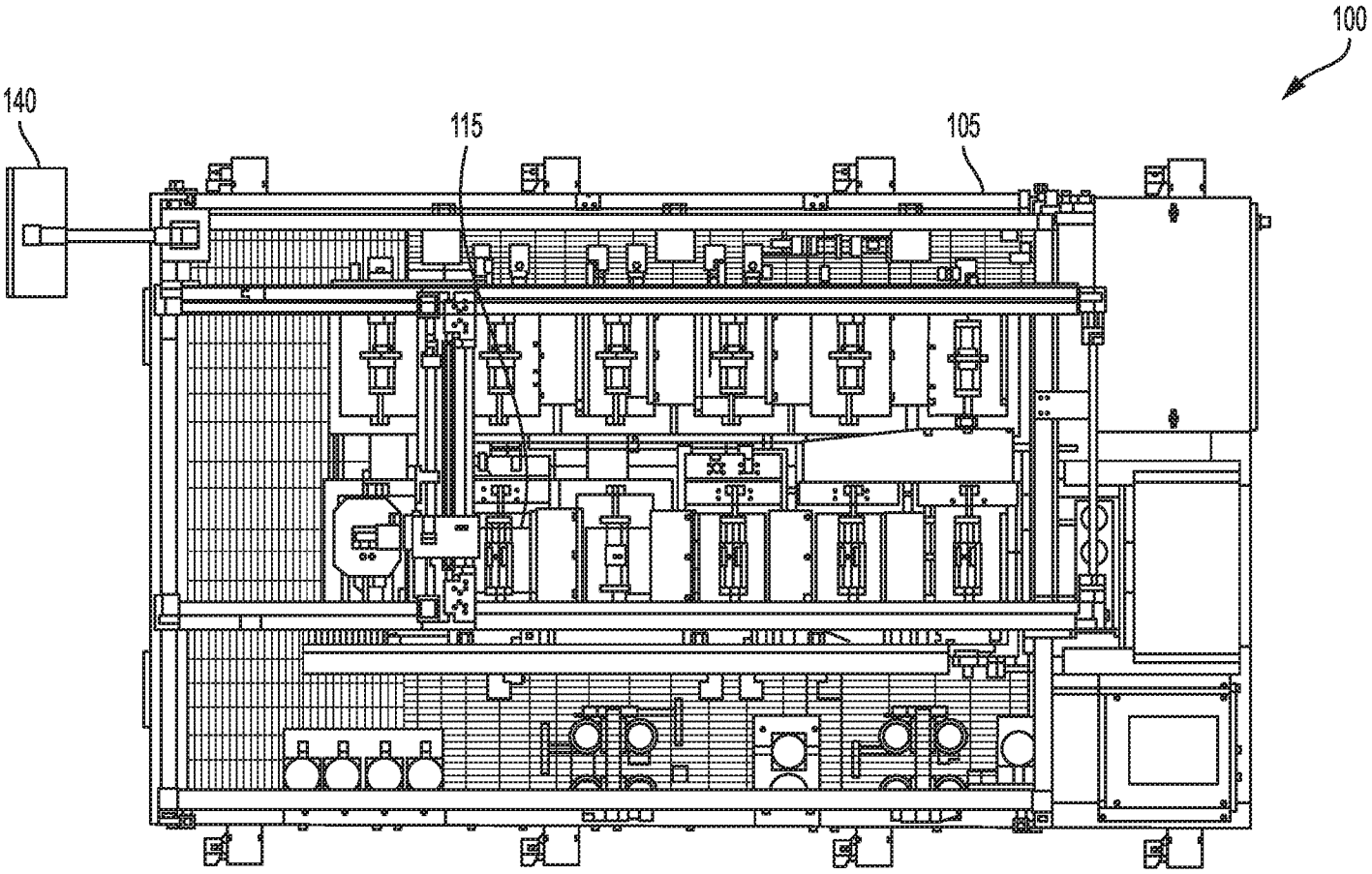
FIG. 3 is a top view of an electroplating system according to embodiments of the present invention.

Referring to FIGS. 1-3, an embodiment of the present invention broadly comprises an electroplating system 100 including a frame 105 with wheels 110 coupled thereto. The wheels 110 can be caster wheels or other movable objects capable of enabling the system 100 to be portable by a user or machine (e.g., palate, sled, etc.). The system 100 can further include plating tanks 115 for electroplating objects, and a robot 125 or other automation for moving racks 120 from one location to another. For example, the robot 125 can move objects to be plated from a plating tank to a cleaning area, or to a separate rack when the electroplating and cleaning processes are complete. The robot 125 can be, for example, a gantry robot or any other automation device.

The system 100 can include filtering and recycling sections 130 within the same system 100. The system 100 can further include spill containment plates 135 for preventing chemicals and other liquids of the system 100 from spilling beyond the confines of the system 100.

Various tanks and sections of the system 100 can be integrated into one system to enhance efficiency and portability of the electroplating system 100. A user can manipulate a control 140 to operate the system 100 with the various functionality. For example, the system 100 can include the plating tanks 115 discussed above, as well as a cleaning tank 145 with ultrasonic or chemical cleaning capabilities, and rinse tanks 180 where electroplated objects can be rinsed with a solution, for example, deionized water. The rinse system can be a counter-flow design, where fresh de-ionized water or other solutions is supplied to the last rinse tank 180 in sequence, and then to a middle rinse tank, and so on up to the first rinse tank in sequence. This causes the object to be plated to be rinsed in progressively cleaner solutions. Comingling of rinses also economizes solution use. Prior to being placed in the last rinse tank, the object can be processed in acid cleaning tank 175. By providing the acid cleaning tank 175 prior to the last rinse tank, the cleaning process can facilitate the use of acid drag-out to act as a purifying agent in the tank and maintain cleanliness in the rinse tank(s).

The various tanks can include sensors 155, for example, conductivity sensors. Metering pumps 160 can also be implemented to automatically provide chemical additives to the various tanks to allow for a more constant, error-free, and automated adjustment, and to minimize the need for human operators to perform the chemical adjustment task. Other sensors can be implemented, for example, liquid level sensors 165, temperature sensors 170, and pH sensors to automate the electroplating process. Water levels, water temperatures, and the pH of chrome and nickel solutions can therefore be automatically monitored and altered.

In an embodiment, the present invention includes a compact and portable electroplating system that is self-contained, rather than disjointed as with conventional electroplating systems. The tanks 115 can include rectifier powered cathodes and anodes for efficient electroplating within the system. By implementing these functionalities within a smaller and more compact system, the system 100 can support efficient one-piece flow or small batch plating. For example, small tanks allow the anode to be closer to the object to be electroplated, as well as the rack that transfers the objects from one location to another, thus maximizing plating efficiency. This increases electroplating efficiency and speed of the electroplating deposits.

Separate baskets can also be employed for even further customization. For example, a third anode basket can be provided in the middle of the tanks 115, in addition to the two baskets located on the sides of the tanks 115. The rack 120 can also straddle the third anode basket to facilitate anode exposure to both sides of the object to be plated. Alternatively, or in addition to the above, a U-shaped rack can be loaded with the parts to be plated. The U-shaped rack can include anodes at both ends, and a third anode in the middle, to allow for uniform plating. Laminar flow can also be used in this and other configurations to increase the solution contact with the part to be plated and speed up the plating process.

The compact nature of the present invention can also allow for quicker heat-up times and less energy expended on heating the solutions of the system 100, compared to conventional electroplating systems. Additionally, the system 100 can be an in-line plating system 100 whereby parts can enter one portion of the system from a previous manufacturing process and move to the next operation in a convenient and efficient assembly line-type fashion.

The rack management system also improves the functionality of the system 100. As discussed above, the system 100 can include a rack 120 operated by a control 140 and robotic automation 125. The rack 120 can include two legs that are each loaded with objects to be electroplated. The rack management system can also provide queue build-up of loaded racks and auto-feeding of racks to the electroplating system based on the demands of a user or automatically. Following the electroplating and/or cleaning and rinsing processes, the racks can be automatically off-loaded back into the rack management system for unloading and recirculating through the system. The solutions used can be mechanically agitated to improve the solution renewal at the surface of the objects to be plated and to eliminate the need for traditional air agitation.

The compact nature of the system 100 also allows additional flexibility. For example, the tanks 115 and other portions of the system 100 can be removably coupled to the frame 105 or other parts of the system to allow quick slide-out and slide-in alterations. The robotic automation 125 can assist with the movement of the tanks and can be programmed so as to automatically arrange the tanks and other sections in a specific order when instructed at the control 140 that the system 100 is to operate in a specific mode.

The filtering and recycling sections 130 can assist in the rinse and solution capabilities of the system 100. For example, the filtering and recycling sections 130 can allow for no discharge and complete recycling of the solutions used for multiple uses. The filtering sections 130 can also be used for metal recovery.

Figure 4:
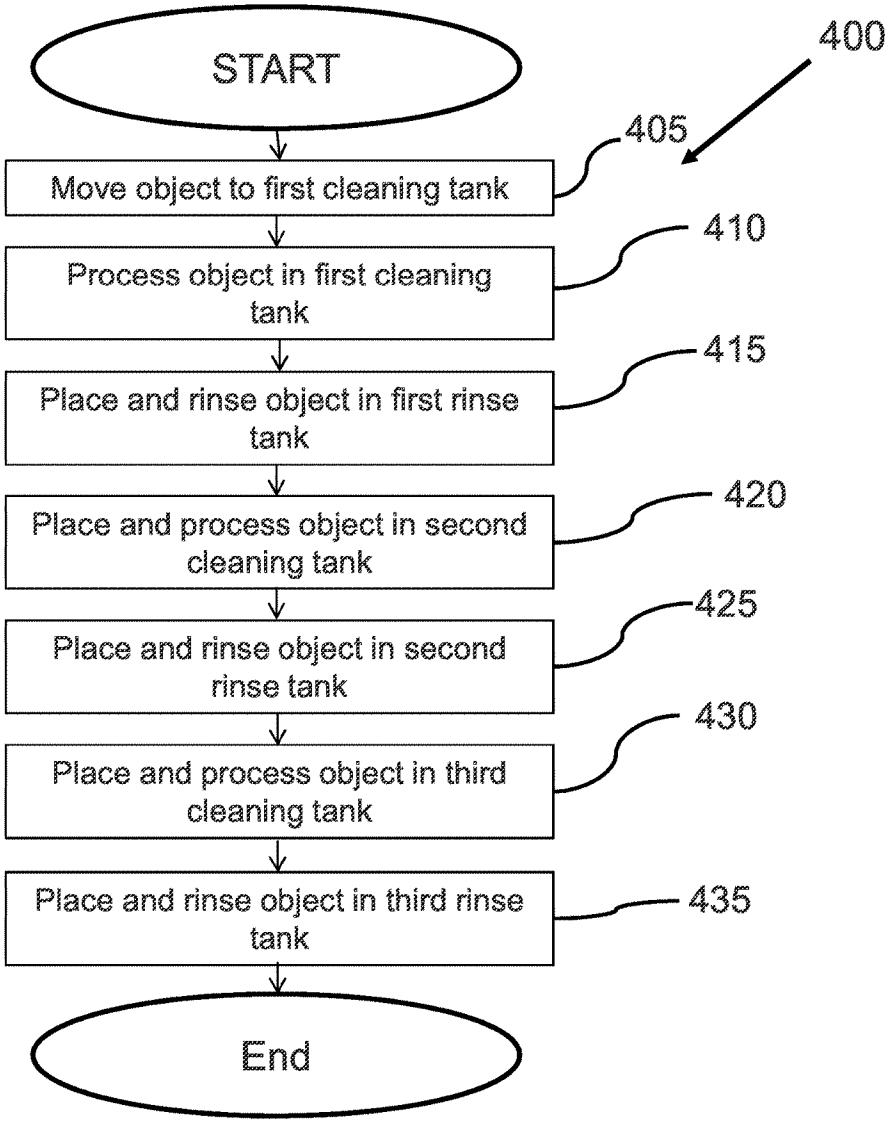
FIG. 4 is a flowchart illustrating a process for cleaning parts according to embodiments of the present application.

A cleaning process will now be described with reference to FIG. 4, and based on at least some of the elements illustrated in FIGS. 1-3. As shown in FIG. 2, the system 100 can include multiple cleaning steps using several cleaning tanks 145 or acid cleaning tanks 175 and rinse tanks 180. The process 400 can therefore begin and proceed to step 405, where an un-plated object moves to first cleaning tank 145. The object then follows to a sequence of rinse and cleaning procedures 410 to 435 where the object is progressively cleaned and rinsed in first second, and third cleaning and rinse tanks. Prior to being placed in the third rinse tank, the object can be processed in an acid cleaning tank 175. By providing the acid cleaning tank 175 prior to the final rinse tank, the cleaning process 400 can facilitate the use of acid drag-out to act as a purifying agent in the tank and to maintain cleanliness in the rinse tank. The rinse system can be a counter-flow design, where fresh solution, such as de-ionized water, is supplied to the last rinse tank 180 in sequence, and then to a middle rinse tank, and so on up to the first rinse tank in sequence. This causes the object to be rinsed in progressively cleaner solution. Comingling of rinses also economizes solution use. The cleaning process can now end and the object can follow to the first plating tank 150. Cleaning process 400 is one of many potential electroplating applications/tank sequences.

Figure 5:
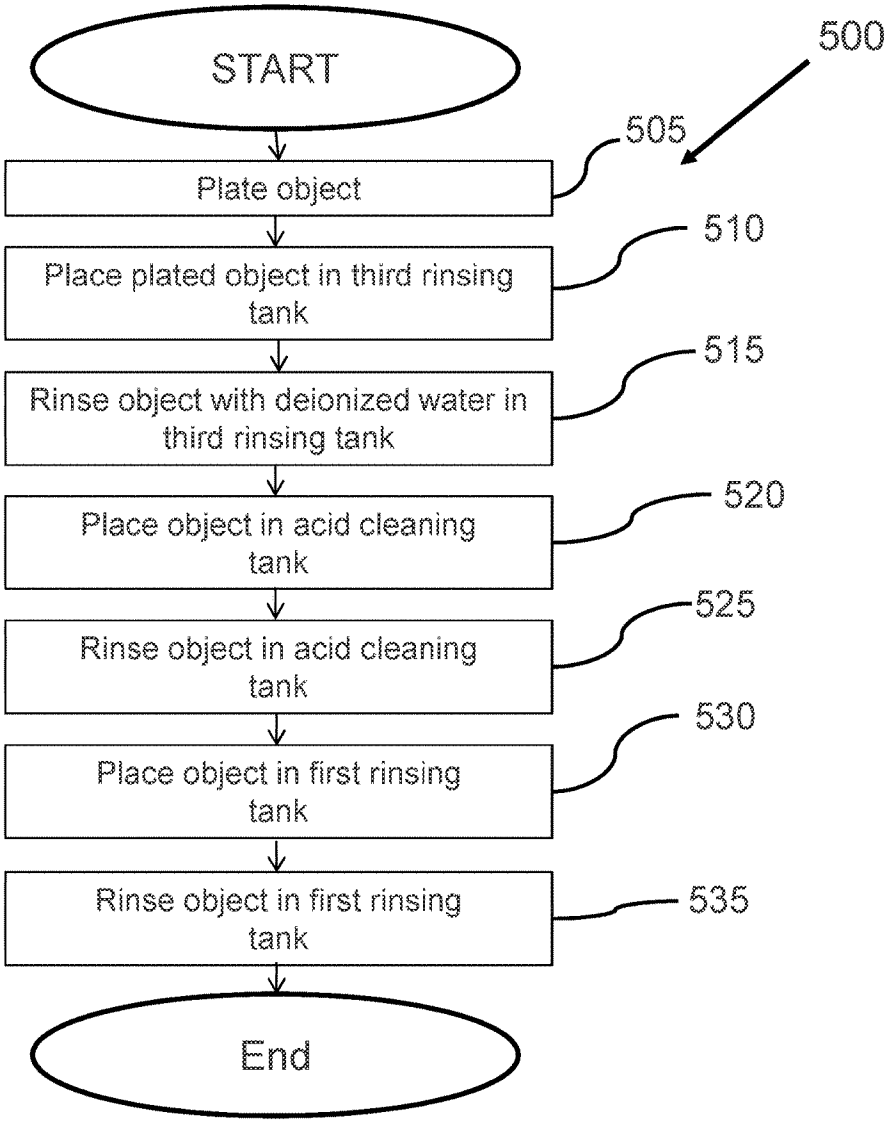
FIG. 5 is a flowchart illustrating a process for cleaning electroplated parts according to embodiments of the present application.

Another cleaning process is also described with reference to FIG. 5, and based on at least some of the elements illustrated in FIGS. 1-3. As shown in FIG. 2, the system 100 can include multiple cleaning steps using several cleaning tanks 145 or acid cleaning tanks 175 and rinse tanks 180. The process 500 can therefore begin and proceed to step 505, where an object is plated. The plated object moves to a third tank (i.e., an initial tank) in step 510. The object is then rinsed with solution, such as de-ionized water, in step 515, and moves to the acid cleaning tank 175 for further cleaning in steps 520 and 525. After being rinsed in the acid cleaning tank, the plated object moves to a first tank for further rinsing in steps 530 and 535 (i.e., a last rinse tank). By providing the acid cleaning tank 175 prior to the last rinse tank (for example, the first tank), the cleaning process 500 can facilitate the use of acid drag-out to act as a purifying agent in the tank and to maintain cleanliness. The rinse system can be a counter-flow design, where fresh solution, such as de-ionized water, is supplied to the last rinse tank 180 in sequence, and then to a middle rinse tank, and so on up to the initial rinse tank in sequence. This causes the object to be rinsed in progressively cleaner solution. Comingling of rinses also economizes solution use. The cleaning process can now end. Cleaning process 500 is one of many potential electroplating applications/tank sequences.

The above process is advantageous in that it allows the objects to be rinsed in progressively cleaner water for best plating results. The commingling of rinses also economizes the water use to improve the efficiency of the cleaning and plating process. The process 400 can clean in any known manner, and as discussed above, can rinse objects using deionized water.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the claims when viewed in their proper perspective based on the prior art.

What is claimed is:

1. A method for electroplating an object, comprising:

causing a solution to flow from a supply source to a first rinse tank that is disposed on a movable frame;

allowing the solution to flow from the first rinse tank to a second rinse tank that is disposed on the movable frame;

using a rack to place the object in a plating tank that is disposed on the movable frame, wherein the rack is coupled to the movable frame and selectively disposable above each of the first rinse tank, second rinse tank, and plating tank;

electroplating the object in the plating tank;

after electroplating the object in the plating tank, placing the object in the second rinse tank;

rinsing the object in the second rinse tank;

after rinsing the object in the second rinse tank, placing the object in an acid cleaning tank that is disposed on the movable frame; and after placing the object in the acid cleaning tank, placing the object in the first rinse tank.

2. The method of claim 1, further comprising prior to rinsing the object in the second rinse tank, placing the object in a third rinse tank that is disposed on the movable frame, wherein the solution flows from the second rinse tank to the third rinse tank.

3. The method of claim 1, wherein the step of using the rack to place the object in the plating tank includes using the rack, wherein first and second anodes are respectively disposed at first and second ends of the rack.

4. The method of claim 1, further comprising causing flow of solution through the plating tank to be laminar.

5. The method of claim 1, wherein the step of using the rack includes using a U-shaped rack.

6. The method of claim 3, wherein the step of using the rack to place the object in the plating tank includes disposing the rack in the plating tank with the rack straddling a third anode disposed in the plating tank.

7. The method of claim 1, wherein the solution includes de-ionized water.

* * * * *